US012759043B2

(12) United States Patent
Mai et al.

(10) Patent No.: US 12,759,043 B2
(45) Date of Patent: Oct. 13, 2026

(54) VACUUM SINTERING APPARATUS

(71) Applicant: Shanghai Fusion Tech Co., Ltd., Shanghai (CN)

(72) Inventors: Wei Mai, Shanghai (CN); Sheng Zhu, Shanghai (CN); Linggang Hu, Shanghai (CN); Chong Wang, Shanghai (CN); Jingjing Qian, Shanghai (CN); Hua Feng, Shanghai (CN); Jianzhe Li, Shanghai (CN); Jinjing Zhang, Shanghai (CN)

(73) Assignee: Shanghai Fusion Tech Co., Ltd., Shanghai (CN)

( * ) Notice: Subject to any disclaimer, the term of this patent is extended or adjusted under 35 U.S.C. 154(b) by 361 days.

(21) Appl. No.: 18/616,120

(22) Filed: Mar. 25, 2024

(65) Prior Publication Data

US 2025/0296146 A1 Sep. 25, 2025

(30) Foreign Application Priority Data

Mar. 24, 2023 (CN) ..... 202310295645.1

(51) Int. Cl.
*B22F 3/00* (2021.01)

(52) U.S. Cl.
CPC ..... *B22F 3/003* (2013.01); *B22F 2201/20* (2013.01); *B22F 2203/11* (2013.01)

(58) Field of Classification Search
CPC ..... B22F 3/003; B22F 2201/20; B22F 3/10; B22F 2999/00
See application file for complete search history.

(56) References Cited

U.S. PATENT DOCUMENTS

2021/0078075 A1* 3/2021 Woodard ..... B22F 3/1021

* cited by examiner

*Primary Examiner* — Jessee R Roe
(74) *Attorney, Agent, or Firm* — AVEK IP, LLC

(57) ABSTRACT

Vacuum sintering apparatus are disclosed. In some embodiments, a vacuum sintering apparatus includes a vacuum cavity body, a power supply assembly, an electrode assembly, a heating body assembly, and a heat-preservation assembly. The heat-preservation assembly is provided within a vacuum chamber. The heat-preservation assembly includes a fixing bracket and a carbon felt heat-preservation layer. The fixing bracket is provided in a square shape or an annular shape. The carbon felt heat-preservation layer is laid around the fixing bracket. The heating body assembly is provided within a zone surrounded by the carbon felt heat-preservation layer. The heating body assembly includes two groups of unidirectional heating channels. The unidirectional heating channel is in an unenclosed square shape or an unenclosed annular shape. The two groups of unidirectional heating channels are connected in series by a connecting member. The connecting member is made of a conductive material.

10 Claims, 5 Drawing Sheets

VACUUM SINTERING APPARATUS

CROSS REFERENCE TO RELATED APPLICATIONS

This application claims priority to Chinese patent application number 202310295645.1, filed on Mar. 24, 2023, the disclosure of which is incorporated by reference herein in its entirety.

FIELD OF THE DISCLOSURE

The disclosure relates generally to the field of metal powder rapid molding. More specifically, the disclosure relates to vacuum sintering apparatus.

BACKGROUND

At present, with the rapid development of MIM industry and 3D printing industry, rapid molding technology of a metal powder is more and more widely used. Technology for post-processing and sintering a molded sample also correspondingly rapidly develops. A vacuum sintering furnace is a post-processing commonly used apparatus of the rapid molding of the metal powder. To achieve a sintering environment with a high temperature and high vacuum, a corresponding vacuum system and a heating system are complex and occupy a large amount of space, so that a vacuum sintering apparatus in the industry has shortcomings such as a larger size, occupation of a large space and high energy consumption, which limit the application occasions of the vacuum sintering furnace.

SUMMARY

The following presents a simplified summary of the invention in order to provide a basic understanding of some aspects of the invention. This summary is not an extensive overview of the invention. It is not intended to identify critical elements or to delineate the scope of the invention. Its sole purpose is to present some concepts of the invention in a simplified form as a prelude to the more detailed description that is presented elsewhere.

In some examples, the disclosure provides a vacuum sintering apparatus, including a vacuum cavity body, a power supply assembly, an electrode assembly, a heating body assembly, and a heat-preservation assembly.

The vacuum cavity body includes a vacuum chamber, the vacuum chamber being configured to be connected to a vacuum pump.

The heat-preservation assembly is provided within the vacuum chamber, the heat-preservation assembly includes a fixing bracket and a carbon felt layer, the fixing bracket is provided in a square shape or an annular shape, and the carbon felt layer is laid around the fixing bracket.

The heating body assembly is provided in a zone surrounded by the carbon felt layer, the heating body assembly includes two groups of unidirectional heating channels, the unidirectional heating channels are in an unenclosed square shape or an unenclosed annular shape, the two groups of unidirectional heating channels are connected in series by a connecting member, and the connecting member is made of a conductive material. And The electrode assembly is provided at an outer side of the vacuum cavity body and includes two groups of electrode assembly parts, the two groups of electrode assembly parts extend into the vacuum chamber and are connected to the two groups of unidirectional heating channels. And the electrode assembly is electrically connected to the power supply assembly.

Optionally, one group of unidirectional heating channel is in the unenclosed square shape, and the one group of unidirectional heating channel includes three first heating blocks, a second heating block, and heating strips, the three first heating blocks and the second heating block being distributed at four corners and the heating strips being distributed on four sides. Heating strips located on three of the four sides are connected in series via the three first heating blocks and the second heating block, one end of heating strip located on fourth side of the four sides is connected to a neighboring first heating block, another end of heating strip located on fourth side of the four sides is not in contact with the second heating block an is connect to the connecting member. The heating strips distributed on the four sides are uniformly distributed along an axial direction of the vacuum chamber. The second heating block is connected to the electrode assembly.

Optionally, the two groups of unidirectional heating channels are distributed along the axial direction of the vacuum chamber, the two first heating blocks along the axial direction of the vacuum chamber are connected to each other via a connecting strip, and the connecting strip is made of an insulating material.

Optionally, the first heating blocks and the second heating block are provided with spacer blocks on outer sides, the spacer blocks are made of the insulating material, and the spacer blocks are in contact with the carbon felt layer so that a heat-preservation spacing for forming a thermal field is provided among the first heating blocks, the second heating block, and the heating strips.

Optionally, the first heating blocks and the second heating block are both provided in an L-shape, the first heating blocks and the second heating block are both provided with step-like lapping parts on inner sides, and an end of the heating strips is lapped to a corresponding lapping part and fixed by a fastening screw. The second heating block is provided with a connecting part on an outer side, the connecting part passes through the heat-preservation assembly and is connected to the electrode assembly, the connecting part is sleeved with a spacer ring, the spacer ring is made of the insulating material, and the spacer ring separates the heat-preservation assembly from the connecting part.

Optionally, the electrode assembly includes an import electrode, a fixing board, a sealing board, a sealing ring, an export electrode, and a water-cooling assembly, the fixing board is fixed to an outer side of the vacuum cavity body, the sealing board is fixed to the fixing board, the import electrode passes through and is provided in the sealing board and the fixing board, and the sealing ring is provided on the sealing board and sleeved on the import electrode, a first end of the import electrode penetrates into an inter part of the vacuum cavity body and is connected to the connecting part, and a second end of the import electrode is connected to the water-cooling assembly, and the export electrode is connected to the import electrode.

Optionally, the import electrode is threadedly connected to the connecting part, the import electrode is a hollow structure, the water-cooling assembly includes a water-cooling seat, a water-cooling pipe, a water inlet connecting joint, and a water outlet connecting joint, the water-cooling seat is butted against a second end of the import electrode, and the water-cooling seat includes a flow passage that is internally communicated with the import electrode, and a first end of the water-cooling pipe is provided within the flow passage and connected to the water inlet connecting joint, and a second end of the water-cooling pipe extends out of the water-cooling seat and is inserted into an inter part of the import electrode, and the water outlet connecting joint is communicated with the flow passage.

Optionally, the power supply assembly includes a DC power supply and two connecting copper rows, a first end of the connecting copper rows is connected to the DC power supply, and a second end of the connecting copper rows is connected to the import electrode.

Optionally, the carbon felt layer includes a plurality of carbon felt heat-preservation boards spliced together, and adjacent carbon felt heat-preservation boards overlaps each other.

Optionally, the vacuum chamber includes an inner layer and an outer layer. A water-cooling sandwich layer is provided between the inner layer and the outer layer. The vacuum sintering apparatus further includes at least two temperature-measuring thermocouples, the temperature-measuring thermocouples being provided on the outer layer of the vacuum chamber and a detection end of the temperature-measuring thermocouples passing through the inner layer and the carbon felt layer.

The temperature-measuring thermocouples are configured to obtain an inner-side temperature of the heating body assembly in real time, one temperature-measuring thermocouple is configured to feed back the inner-side temperature to a control module, the control module controls an output of the power supply assembly to control a heating power of heating strips, and another temperature-measuring thermocouple is configured to feed back the inner-side temperature to the control module, and the control module controls power cut-off of the power supply assembly when the inner-side temperature is higher than a set value. The control module is configured to determine whether the temperature-measuring thermocouples are normal based on the inner-side temperature obtained by the two temperature-measuring thermocouples.

In other embodiments, the vacuum cavity body has a vacuum chamber. The vacuum chamber is configured to be connected to a vacuum pump and form a vacuum environment. The heat-preservation assembly is provided within the vacuum chamber. The heat-preservation assembly includes a fixing bracket and a carbon felt heat-preservation layer. The fixing bracket is provided in a square shape or an annular shape. The carbon felt heat-preservation layer is laid around the fixing bracket.

The heating body assembly is provided in a zone surrounded by the carbon felt heat-preservation layer. The heating body assembly includes two groups of unidirectional heating channels. The unidirectional heating channel is in an unenclosed square shape or an unenclosed annular shape. The two groups of unidirectional heating channels are connected in series by a connecting member. The connecting member is made of a conductive material.

The electrode assembly is provided at the outer side of the vacuum cavity body. The two groups of electrode assemblies are provided. The two groups of electrode assemblies extend into the vacuum chamber and are connected to the two groups of unidirectional heating channels, respectively. The electrode assembly is electrically connected to the power supply assembly.

Optionally, the unidirectional heating channel is in the unenclosed square shape. The unidirectional heating channel includes a first heating block and a second heating block that are distributed at four corners, respectively, and heating strips distributed at four sides.

The three first heating blocks are provided. One second heating block is provided. The heating strips located on three of the sides are connected in series via the first heating block and the second heating block. One end of the heating strip located on the other side is fixedly connected to the neighboring first heating block, and the other end thereof is not in contact with the second heating block and is fixedly connected to the connecting member.

The plurality of heating strips on each side are provided and uniformly distributed in an axial direction of the vacuum chamber. The second heating block is connected to the electrode assembly.

Optionally, the two groups of unidirectional heating channels are distributed in the axial direction of the vacuum chamber. The two first heating blocks in the axial direction of the vacuum chamber are connected to each other via a connecting fixing strip. The connecting fixing strip is made of an insulating material.

Optionally, the first heating block and the second heating block are provided with protruding spacer blocks on outer sides. The spacer block is made of the insulating material. The spacer block is in contact with the carbon felt heat-preservation layer so that a heat-preservation spacing for forming a thermal field is provided among the first heating block, the second heating block, and the heating strip.

Optionally, the first heating block and the second heating block are both provided as an L-shape. The first heating block and the second heating block are both provided with a step-like lapping part on inner sides. The end of the heating strip is lapped to the corresponding lapping part and fixed by a fastening screw.

The second heating block is provided with a columnar connecting part on an outer side thereof. The connecting part passes through the heat-preservation assembly and is connected to the electrode assembly. The connecting part is sleeved with a spacer ring. The spacer ring is made of the insulating material. The spacer ring separates the heat-preservation assembly from the connecting part.

Optionally, the carbon felt heat-preservation layer includes a plurality of carbon felt heat-preservation boards spliced together. The adjacent carbon felt heat-preservation boards overlap each other.

Optionally, the electrode assembly includes an import electrode, a fixing board, a sealing board, a sealing ring, an export electrode, and a water-cooling assembly.

The fixing board is fixed to the outer side of the vacuum cavity body. The sealing board is fixed to the fixing board. The import electrode passes through and is provided in the sealing board and the fixing board. The sealing ring is provided on the sealing board and sleeved on the import electrode;

The first end of the import electrode penetrates into an inter part of the vacuum cavity body and is connected to the connection part, and a second end thereof is connected to the water-cooling assembly;

The export electrode is fixedly connected to the import electrode.

Optionally, the import electrode is threadedly connected to the connection part.

The import electrode is a hollow structure. The water-cooling assembly includes a water-cooling seat, a water-cooling pipe, a water inlet connecting joint, and a water outlet connecting joint. The water-cooling seat is sealingly butted against the second end of the import electrode. The water-cooling seat has a flow passage that is internally communicated with the import electrode.

The first end of the water-cooling pipe is fixedly provided within the flow passage and connected to the water inlet connecting joint, and the second end thereof extends out of the water-cooling seat and is inserted into the inter part of the import electrode. The water outlet connecting joint is communicated with the flow passage.

Optionally, the power supply assembly includes a DC power supply and a connecting copper row. The two connecting copper rows are provided. The first end of the connecting copper row is connected to the DC power supply, and the second end thereof is connected to the import electrode. The DC power supply is configured to output a small voltage and a large current.

Optionally, the vacuum chamber includes an inner layer and an outer layer. A water-cooling sandwich layer is provided between the inner layer and the outer layer.

The vacuum sintering apparatus further includes at least two temperature-measuring thermocouples. The temperature-measuring thermocouple is provided on the outer layer of the vacuum chamber. The detection end of the temperature-measuring thermocouple passes through the inner layer and the carbon felt heat-preservation layer.

The temperature-measuring thermocouple is configured to obtain an inner-side temperature of the heating body assembly in real time. One temperature-measuring thermocouple is configured to feed back the inner-side temperature to a control module. The control module controls the output of the power supply assembly to control the heating power of the heating strip. The other temperature-measuring thermocouple is configured to feed back the inner-side temperature to the control module. The control module controls the power cut-off of the power supply assembly when the inner-side temperature is higher than a set value.

The control module may determine whether the temperature-measuring thermocouple is normal based on the inner-side temperature obtained by the two temperature-measuring thermocouples.

In an embodiment of the disclosure, the vacuum chamber, the power supply assembly, the electrode assembly, the heating body assembly, and the heat-preservation assembly are provided. The vacuum cavity body has the vacuum chamber. The vacuum chamber is configured to be connected to the vacuum pump and form the vacuum environment. The heat-preservation assembly is provided within the vacuum chamber. The heat-preservation assembly includes the fixing bracket and the carbon felt heat-preservation layer. The fixing bracket is provided in a square shape or an annular shape. The carbon felt heat-preservation layer is laid around the fixing bracket. The heating body assembly is provided within the zone surrounded by the carbon felt heat-preservation layer. The heating body assembly includes two groups of unidirectional heating channels. The unidirectional heating channel is in an unenclosed square shape or an unenclosed annular shape. The two groups of unidirectional heating channels are connected in series by a connecting member. The connecting member is made of the conductive material. The electrode assembly is provided at the outer side of the vacuum cavity body. The two groups of electrode assemblies are provided. The two groups of electrode assemblies extend into the vacuum chamber to be connected to the two groups of unidirectional heating channels. The electrode assembly is electrically connected to the power supply assembly. Such embodiment utilizes the carbon felt heat-preservation layer and the fixing bracket to form a square-shaped or annular heat-preservation assembly, being able to form a heat-preservation zone in a smaller zone to meet the requirements, and utilizing the two groups of unidirectional heating channels to form the square-shaped or annular heating body assembly in the heat-preservation zone, and being able to form a high-temperature and temperature-uniformity heated zone in a smaller zone.

BRIEF DESCRIPTION OF THE DRAWINGS

Illustrative embodiments of the present disclosure are described in detail below with reference to the attached drawing FIGS.

DETAILED DESCRIPTION

Figure 1:
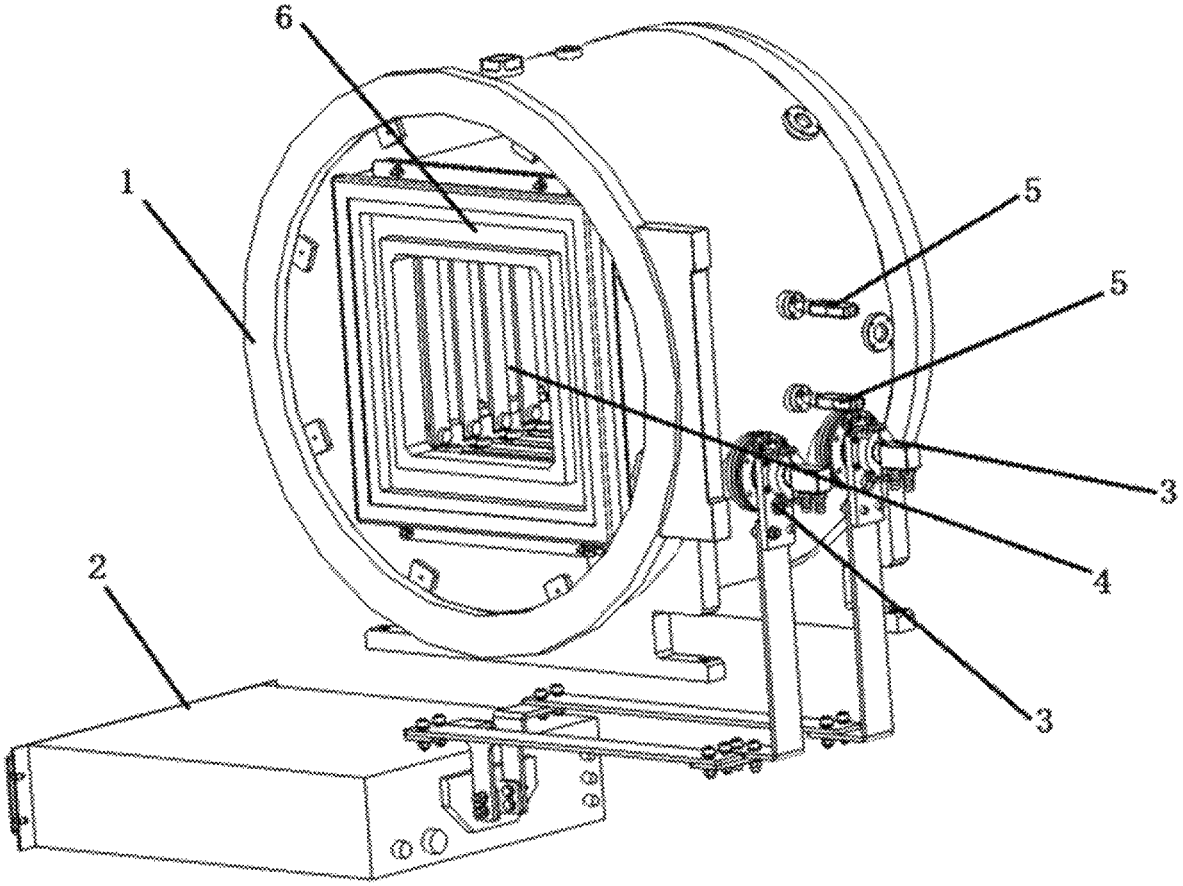
FIG. 1 shows a schematic structural diagram according to an embodiment of the disclosure according to an embodiment of the disclosure.

The following describes some non-limiting exemplary embodiments of the invention with reference to the accompanying drawings. The described embodiments are merely a part rather than all of the embodiments of the invention. All other embodiments obtained by a person of ordinary skill in the art based on the embodiments of the disclosure shall fall within the scope of the disclosure.

To enable a person skilled in the art to better understand the embodiments of the disclosure, the following clearly and completely describes the technical solutions in embodiments of the disclosure in conjunction with the accompanying drawings in the embodiments of the disclosure. Obviously, the described embodiments are a part of the embodiments of the disclosure, rather than all embodiments. Based on the embodiments of the disclosure, all other embodiments obtained by a person skilled in the art without inventive work shall fall within the protection scope of the disclosure.

It should be noted that the terms "first" and "second" in the description and claims of the disclosure and the forgoing drawings are used to distinguish similar objects, but are not necessarily used to describe a specific order or sequence. It should be understood that data so used may be interchangeable, where appropriate, for the embodiments of the disclosure described herein.

In the disclosure, the orientation or positional relationships indicated by the terms "up", "down", "within", etc. are based on the orientation or positional relationships shown in the accompanying drawings. These terms are used primarily to better describe the disclosure and the embodiments thereof, and are not intended to define that indicated devices, elements, or assemblies should have a particular orientation, or be constructed and operated in a particular orientation.

Moreover, some of the forgoing terms may be used to indicate other meanings in addition to the orientation or positional relationships, for example, the term "on" may also be used in some cases to indicate some relationship of dependency or connection. For a person skilled in the art, the specific meaning of these terms in the disclosure may be understood based on specific situations.

In addition, the terms "provided", "provided with", "connected", "fixed", etc. should be understood in a broad sense. For example, "connected" may refer to fixed connection, detachable connection, or an integral structure, may refer to mechanical connection or electrical connection, and may refer to direct connection, indirect connection through an intermediate medium, or internal communication between two devices, two elements, or two assemblies. For a person skilled in the art, the specific meaning of the forgoing terms in the disclosure may be understood based on specific situations.

In addition, the term "a plurality of" shall mean two and more than two.

It is to be noted that the embodiments of the disclosure and the features of the embodiments may be combined with each other without conflict. The disclosure will be described in detail below in combination with embodiments with reference to the accompanying drawings.

At present, with the rapid development of MIM industry and 3D printing industry, rapid molding technology of a metal powder is more and more widely used. Technology for post-processing and sintering a molded sample also correspondingly rapidly develops. A vacuum sintering furnace is a post-processing commonly used apparatus of the rapid molding of the metal powder. To achieve a sintering environment with a high temperature and high vacuum, a corresponding vacuum system and a heating system are complex and occupy a large amount of space, so that a vacuum sintering apparatus in the industry has shortcomings such as a larger size, occupation of a large space and high energy consumption, which limit the application occasions of the vacuum sintering furnace.

For a large site occupied by a vacuum sintering furnace in the prior art, a complex system, and other drawbacks and defects, a compact and practical vacuum heating system is designed, so that a vacuum sintering furnace has a greatly reduced entire volume. This controls the entire outline volume of an apparatus in the shape of 1500*1200*2000 mm to meet the requirements of domestic conventional laboratories, office buildings and other venues. Application occasions are not limited. In addition, a compact heating system and a compact structure are designed, greatly reducing heat loss. Therefore, the energy consumption of the system is greatly reduced, which is more advantageous in terms of costs and energy saving.

In FIGS. 1 to 5, 1 represents vacuum cavity body, 2 represents power supply assembly, 21 represents DC power supply, 22 represents connecting copper row, 3 represents electrode assembly, 31 represents import electrode, 32 represents fixing board, 33 represents sealing board, 34 represents sealing ring, 35 represents export electrode, 36 represents water-cooling pipe, 37 represents water outlet connecting joint, 38 represents water inlet connecting joint, 39 represents water-cooling seat, 40 represents flow passage, 4 represents heating body assembly, 400 represents unidirectional heating channel, 41 represents first heating block, 42 represents heating strip, 44 represents connecting fixing strip, 45 represents spacer block, 46 represents spacer ring, 47 represents second heating block, 471 represents connecting part, 5 represents temperature-measuring thermocouple, 6 represents heat-preservation assembly, 61 represents carbon felt heat-preservation layer, 62 represents fixing bracket.

As examples shown in FIGS. 1 to 5, an embodiment of the disclosure provides a vacuum sintering apparatus, which may include a vacuum cavity body 1, a power supply assembly 2, an electrode assembly 3, a heating body assembly 4, and a heat-preservation assembly 6.

The vacuum cavity body 1 has a vacuum chamber. The vacuum chamber is configured to be connected to a vacuum pump and form a vacuum environment.

The heat-preservation assembly 6 is provided within the vacuum chamber. The heat-preservation assembly 6 may include a fixing bracket 62 and a carbon felt heat-preservation layer 61. The fixing bracket 62 is provided in a square shape or an annular shape. The carbon felt heat-preservation layer 61 is laid around the fixing bracket 62.

The heating body assembly 4 is provided in a zone surrounded by the carbon felt heat-preservation layer 61. The heating body assembly 4 may include two groups of unidirectional heating channels 400. The unidirectional heating channel 400 is in an unenclosed square shape or an unenclosed annular shape. The two groups of unidirectional heating channels 400 are connected in series by a connecting member. The connecting member is made of a conductive material.

The electrode assembly 3 is provided at the outer side of the vacuum cavity body 1. The two groups of electrode assemblies 3 are provided. The two groups of electrode assemblies 3 extend into the vacuum chamber and are connected to the two groups of unidirectional heating channels 400, respectively. The electrode assembly 3 is electrically connected to the power supply assembly 2.

In this embodiment, the vacuum sintering apparatus mainly consists of the vacuum chamber 1, the power supply assembly 2, the electrode assembly 3, the heating body assembly 4, and the heat-preservation assembly 6. The vacuum cavity body 1 has a vacuum chamber that may be closed. After the vacuum cavity body 1 is connected to the vacuum pump, the vacuum chamber may form a stable vacuum environment under the action of the vacuum pump. The vacuum cavity body 1 may be of a cylindrical structure as a whole, with one end closed and the other end open and provided with a sealing door that may be closed. An operator may feed a material into the apparatus through the open end. A mounting supporting foot may be provided within the vacuum chamber for mounting and supporting the heat-preservation assembly 6 and the heating body assembly 4 that are located within the vacuum chamber. The specific position and form of the mounting supporting foot may be determined according to a supported object. The vacuum cavity body 1 may be double-welded. A sandwich layer is cooled by water to prevent the cavity body from causing burns and affecting other devices due to a too high temperature.

Figure 3:
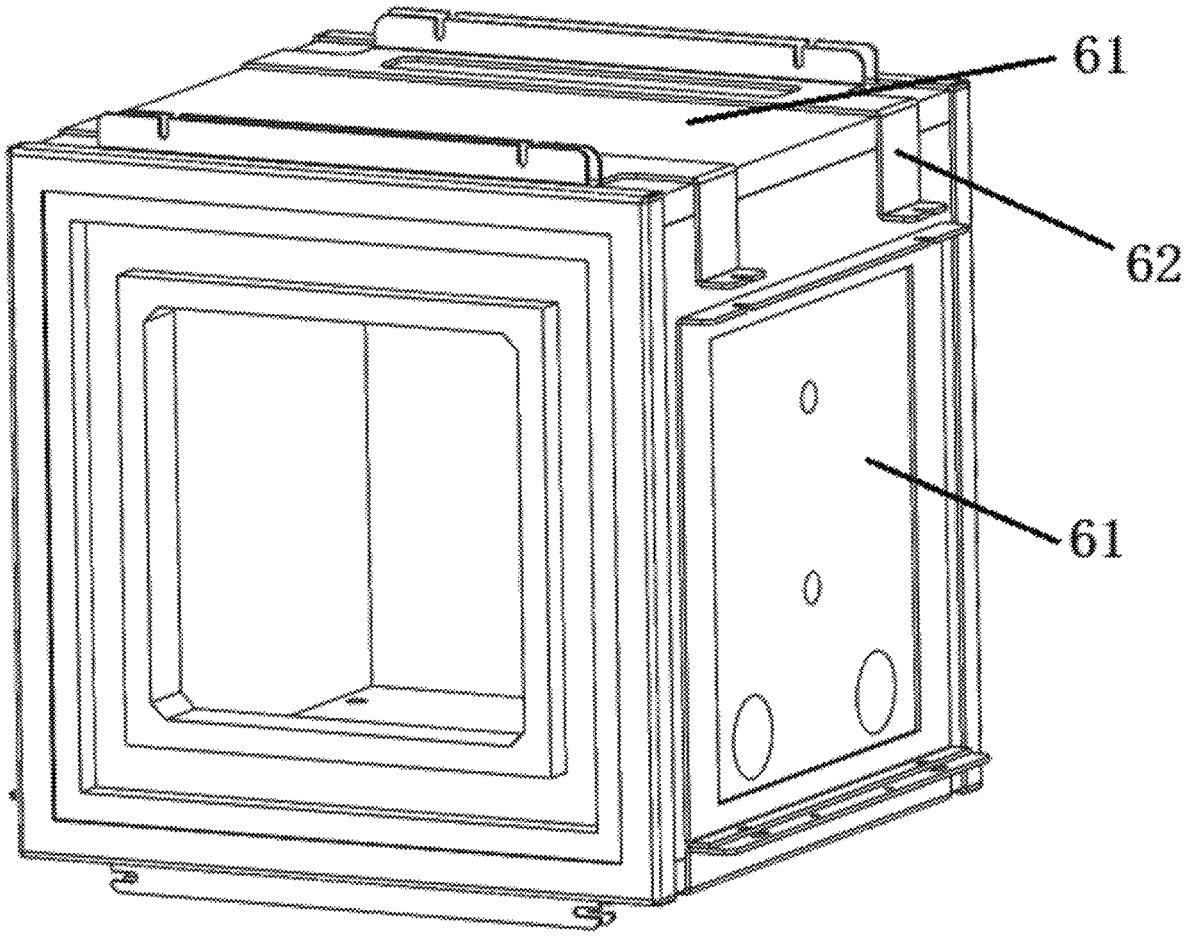
FIG. 3 shows a schematic structural diagram of a heat-preservation assembly according to an embodiment of the disclosure according to an embodiment of the disclosure.

The heat-preservation assembly 6 and the heating body assembly 4 are two important parts of the vacuum sintering apparatus. The heat-preservation assembly 6 needs to have good heat-preservation performance. The heating body assembly 4 needs to have good heating performance. The heat-preservation assembly 6 and the heating body assembly 4 may cooperate to form a high-temperature and temperature-uniformity heated zone within the vacuum chamber. In this embodiment, the heat-preservation assembly 6 consists of two parts. One part is a rigid fixing bracket 62, and the other part is a carbon felt heat-preservation layer 61. Taking as an example the square-shaped heat-preservation assembly 6, as shown in FIG. 3, a square-shaped fixing bracket 62 that is formed by a plurality of high-temperature-resistant rigid materials spliced together is first adopted. The fixing bracket 62 has five mounting surfaces at the top, bottom, left, right and rear sides. The carbon felt heat-preservation layer 61 may be provided on the five mounting surfaces of the fixing bracket 62. The carbon felt heat-preservation layer 61 is made of a carbon felt material with high heat-preservation performance, which has a thickness of about 40 mm to realize a good heat-preservation effect. Whereas an ordinary heat-preservation material forms the heat-preservation layer with a thickness of about 100 mm. The heat-preservation layer of this embodiment may be 60% smaller in a thickness dimension, greatly reducing a space occupied by a heat-preservation structure. Further, the formed square-shaped heat-preservation zone may also have a better heat-preservation effect, greatly reducing heat loss, and reducing the energy consumption of the system. This is more advantageous in terms of energy saving, emission reduction and costs.

Figure 2:
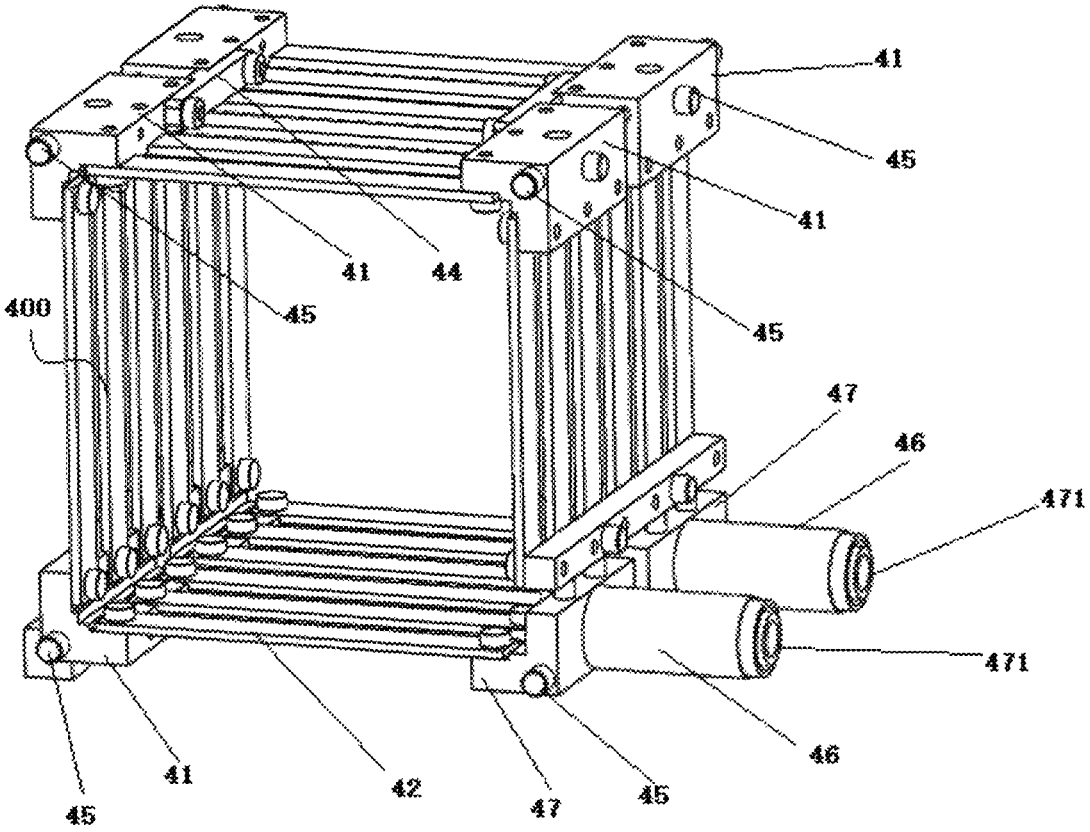
FIG. 2 shows a schematic structural diagram of a heating body assembly according to an embodiment of the disclosure according to an embodiment of the disclosure.

The heating body assembly 4 consists of the two groups of unidirectional heating channels 400. The two groups of unidirectional heating channels 400 are both provided in the unenclosed annular shape or the unenclosed square shape. Taking a rectangle as an example, the three edges of the unidirectional heating channel 400 are connected in a sequence, while the fourth edge thereof is connected only to the third edge and not to the first edge, thereby forming an unenclosed rectangular structure. As shown in FIG. 2, the unidirectional heating channel 400 is made of an electrically heated material, such as graphite. The unidirectional heating channel 400 may generate heat after being energized. The two groups of unidirectional heating channels 400 are provided in the heat-preservation zone formed by the heat-preservation assembly 6 and distributed axially along the vacuum chamber. To facilitate the connection of the two groups of unidirectional heating channels 400 to the power supply assembly 2, in this embodiment, the two groups of electrode assemblies 3 are provided on the vacuum cavity body 1. The two groups of electrode assemblies 3 are connected to the two groups of unidirectional heating channels 400, respectively. Because a separate group of unidirectional heating channels 400 cannot form a circuit, in this embodiment, the two groups of unidirectional heating channels 400 are connected by a connection member. A final current circuit is formed as follows: the first group of electrode assemblies 3 are responsible for the inflow of a current, and the current flows through the first group of unidirectional heating channels 400 and then flows into the second group of unidirectional heating channels 400 through the connection member, and finally flows out through the second group of electrode assemblies 3. The entire heating body assembly 4 in this embodiment is designed according to the sintering zone of a sample to realize the heating area in the smallest space zone. The unidirectional heating channel 400 of a square-shaped frame better ensures temperature uniformity.

This embodiment utilizes the carbon felt heat-preservation layer 61 and the fixing bracket 62 to form the square-shaped or annular heat-preservation assembly 6, being able to form the heat-preservation zone in a smaller zone to meet the requirements, and utilizing the two groups of unidirectional heating channels 400 to form the square-shaped or annular heating body assembly 4 in the heat-preservation zone, and being able to form a high-temperature and temperature-uniformity heated zone in a smaller zone. Therefore, this realizes the following technical effects: vacuum and the heating system are integrated within a small space; the whole system has high space utilization and occupies a small zone; and the design of a compact and efficient heat-preservation structure and excellent heat-preservation effect reduce the heat loss, so that the energy consumption of the system is greatly reduced, thereby reducing production costs. This further solves the problems that for the vacuum sintering furnace in the prior art, to realize the sintering environment with the high temperature and the high vacuum, the corresponding vacuum system and the heating system are complex and occupy a large space so that the vacuum sintering apparatus in the industry at present has the large volume, occupies the large space, and has the high energy consumption.

The structure of the unidirectional heating channel 400 affects the heating performance of the heating body assembly 4, which in turn affects the volume of the entire vacuum sintering furnace. To make the unidirectional heating channel 400 structurally satisfactory, in this embodiment, the unidirectional heating channel 400 is described in detail:

As shown in FIG. 2, the unidirectional heating channel 400 is in the unenclosed square shape. The unidirectional heating channel 400 may include a first heating block 41 and a second heating block 47 distributed at corners, respectively, and heating strips 42 distributed at four sides;

The three first heating blocks 41 are provided. One second heating block 47 is provided. The heating strips 42 located on three of the sides are connected in series via the first heating block 41 and the second heating block 47. One end of the heating strip 42 located on the other side is fixedly connected to the neighboring first heating block 41, and the other end thereof is not in contact with the second heating block 47 and is fixedly connected to the connecting member.

The plurality of heating strips 42 on each side are provided and uniformly distributed in an axial direction of the vacuum chamber. The second heating block 47 is connected to the electrode assembly 3.

In this embodiment, the first heating block 41, the second heating block 47, and the heating strip 42 use isostatically pressed graphite as a heating carrier, and are sequentially connected to build a square-shaped frame structure. The isostatically pressed graphite, with excellent processing performance and high temperature resistance, is an excellent material for a heat generator. The heating strips 42 distributed on the four sides are connected in series by the corresponding first heating block 41 and the second heating block 47. The lower end of the heating strip 42 located on the right side is not connected to the second heating block 47, but is connected to the connecting member, so that the heating strips 42 of the two groups of unidirectional heating channels 400 are both connected in series. The connecting member is made of graphite. The two groups of unidirectional heat channels are connected in series with the conductive properties of graphite. The three heating strips 42 on one side of each of the unidirectional heating channels 400 may be provided. Spacings between the three heating strips 42 are the same. The three heating strips 42 are connected in parallel to expand a heating area, which may realize better temperature uniformity. One finally formed unidirectional heating channel 400 has the twelve heating strips 42. The two unidirectional heating channels 400 have the twenty-four heating strips 42, which enables a sufficient temperature to be generated in a small space and temperature uniformity to be maintained.

As shown in FIG. 2, the two groups of unidirectional heating channels 400 are distributed in the axial direction of the vacuum chamber. To make the entire structure of the two groups of unidirectional heating channels 400 stable after being connected, the two first heating blocks 41 in the axial direction of the vacuum chamber in this embodiment are connected to each other by a connecting fixing strip 44. The connecting fixing strips 44 is made of an insulating material. In other words, the first heating blocks 41 in the same direction of the two groups of unidirectional heating channels 400 are connected by the connecting fixing strip 44. The connection fixing strip 44 and the corresponding first heating block 41 may be fixed to each other by a bolt. The connecting fixing strip 44 may be made of the insulating material, such as a ceramic member.

Because the heating body assembly 4 needs to be electrically heated, and the heating body assembly 4 is mounted on the inner side of the heat-preservation assembly 6, to avoid direct contact between the heating body assembly 4 and the heat-preservation assembly 6 from affecting a heating effect, in this embodiment, a protruding spacer block 45 is provided on the outer sides of the first heating block 41 and the second heating block 47. The spacer block 45 is made of an insulating material. The spacer block 45 is in contact with the carbon felt heat-preservation layer 61, so that an insulating spacing for forming a thermal field is formed among the first heating block 41, the second heating block 47, and the heating strips 42.

Specifically, in this embodiment, the spacer block 45 is provided at the left side and the front end of the first heating block 41 located at the upper left corner of the unidirectional heating channel 400 on the front side. The spacer block 45 is provided at the front, lower and left ends of the first heating block 41 located at the lower left corner of the unidirectional heating channel 400. The spacer block 45 is provided at the front end and the right end of the first heating block 41 located at the upper right corner of the unidirectional heating channel 400. The spacer block 45 is provided at the front end and the lower end of the second heating block 47 located at the lower right corner of the unidirectional heating channel 400. The spacer block 45 is located on the left side and the rear end of the first heating block 41 located at the upper left corner of the unidirectional heating channel 400 on the rear side. The spacer block 45 is provided at the rear end, the lower end and the left end of the first heating block 41 located at the lower left corner of the unidirectional heating channel 400. The spacer block 45 is provided at the rear end and the right end of the first heating block 41 located at the upper right corner of the unidirectional heating channel 400. The spacer block 45 is provided at the rear end and the lower end of the second heating block 47 located at the lower right corner of the unidirectional heating channel 400. The spacer block 45 is provided in such a way that the entire heating body assembly 4 may maintain heat-preservation spacings between the front end, the lower end, the left end, the right end, and the rear end as well as the inner side of the heat-preservation assembly 6, while the upper end and the heat-preservation assembly 6 may be dimensioned therebetween to achieve this heat-preservation spacing.

In this embodiment, the spacer block 45 may be machined from a boron nitride ceramic material, which is high temperature resistant and insulated. The heating strip 42 and the heating block may also be supported by the spacer block 45. After mounting, the heating body assembly 4 and the heat-preservation assembly 6 are separated by the spacer block 45 for support and heat-preservation. A compact mounting way provides more efficient heat-preservation performance and thermal field zone, while reducing an entire mounting space.

Because the heating strip 42 needs to be connected to the corresponding heating block, and the first heating block 41 needs to be connected to the heating strip 42 on both sides, to facilitate the mounting and disassembly of the heating strip 42, as shown in FIG. 2, in this embodiment, the first heating block 41 and the second heating block 47 are both provided as an L-shape. The inner sides of the first heating block 41 and the second heating block 47 are provided to have a step-like lapping part. The end of the heating strip 42 is lapped to the corresponding lapping part and fixed by a fastening screw. The fastening screw is processed with CC composite material, which is of high strength, and still maintains strength and excellent fastening performance after processed under a high temperature, while also facilitates mounting and disassembly. The lapping part may quickly and accurately locate the position of the heating strip 42, i.e., a surface heating strip 42 is located in a mounting position when the end surfaces of the heating strip 42 and the lapping part are against each other. The installation efficiency may be improved, while the lapping part may also increase a contact area between the heating strip 42 and the heating block.

To facilitate the connection between the second heating block 47 and the electrode assembly 3, in this embodiment, the second heating block 47 is provided with a columnar connecting part 471 on the outer side. The connecting part 471 passes through the heat-preservation assembly 6 and is connected to the electrode assembly 3. The connecting part 471 is sleeved with a spacer ring 46. The spacer ring 46 is made of the insulating material. The spacer ring 46 separates the heat-preservation assembly 6 from the connecting part 471. The spacer block 45 and the spacer ring 46 may be machined from the boron nitride ceramic material, which is high temperature resistant and insulated.

To further improve the heat-preservation performance of the heat-preservation assembly 6, as shown in FIG. 3, in this embodiment, the carbon felt heat-preservation layer 61 consists of a plurality of carbon felt heat-preservation boards spliced together. The adjacent carbon felt heat-preservation boards are lapped over each other so as to eliminate a gap between the adjacent carbon felt heat-preservation boards, and to be able to cover comprehensively. The fixing bracket 62 for supporting the carbon felt heat-preservation layer 61 may be formed by bending stainless steel. A U-shaped fixing hole may be opened between the fixing brackets 62 of adjacent surfaces for easy fixing and disassembly of a bolt.

Figure 4:
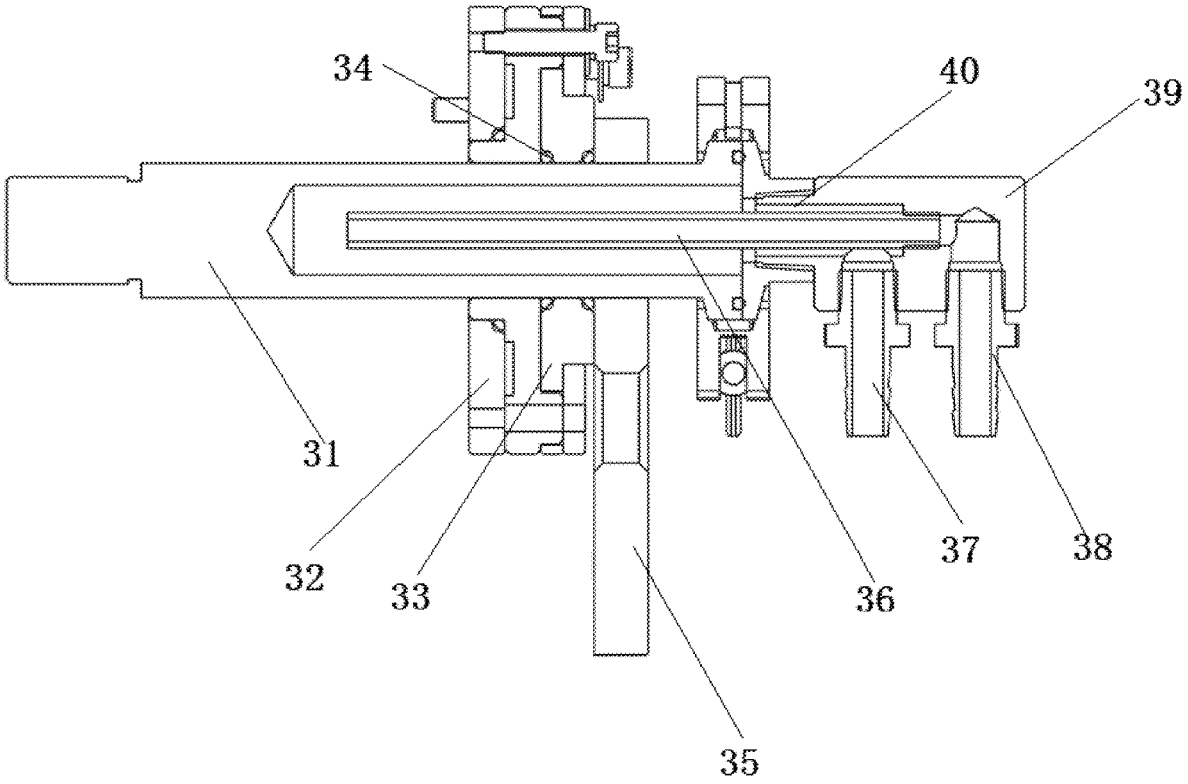
FIG. 4 shows a schematic structural diagram of an electrode assembly according to an embodiment of the disclosure according to an embodiment of the disclosure.

The electrode assembly 3 is configured to be connected to the second heating block 47 and the power supply assembly 2, which is described in detail in this embodiment:

As shown in FIG. 4, in this embodiment, the electrode assembly 3 may include an import electrode 31, a fixing board 32, a sealing board 33, a sealing ring 34, an export electrode 35, and a water-cooling assembly.

The fixing board 32 is fixed to the outer side of the vacuum cavity body 1. The sealing board is 33 fixed to the fixing board 32. The import electrode 31 passes through and is provided in the sealing board 33 and the fixing board 32. The sealing ring 34 is provided on the sealing board 33 and sleeved on the import electrode 31.

The first end of the import electrode 31 penetrates into the inter part of the vacuum cavity body 1 and is connected to the connection part 471, and a second end thereof is connected to the water-cooling assembly.

The export electrode 35 is fixedly connected to the import electrode 31.

In this embodiment, the fixing board 32 is fixed to an electrode mounting flange on the outer side of the vacuum cavity body 1. The import electrode 31, the sealing board 33, the sealing ring 34, and the export electrode 35 are mounted integrally to the fixing board 32 after being pre-assembled together. The right side of the carbon felt heat-preservation layer 61 is opened and provided with a hole position for the connecting part 471 of the second heating block 47 to pass through. The right side of the vacuum cavity body 1 is provided with a hole position for the import electrode 31 to pass through. The import electrode 31 may be docked with the connection part 471 to realize conduction after being mounted. To improve the sealing performance, in this embodiment, the import electrode 31 and the sealing board 33 are sealed with each other by the two sealing rings 34. The two sealing rings are located on the two sides of the sealing board 33. The sealing board 33 is connected to the fixed board 32 via a flange. The sealing ring 34 may be a fluor elastomer O-ring, which improves the sealing effect of the electrode assembly 3 and thus the sealing degree of the vacuum cavity body 1. To facilitate the cooling of the import electrode 31, in this embodiment, the water-cooling assembly is connected to the second end of the import electrode 31. The import electrode 31 is cooled by water with the water-cooling assembly.

To facilitate the connection and disassembly of the import electrode 31 and the connecting part 471, in the present embodiment, the import electrode 31 is threadedly connected to the connection part 471. Specifically, the connecting part 471 is opened and provided with an internal thread at the right end. The import electrode 31 is opened and provided with an external thread at the left end, so as to realize the connection and disassembly through threaded fit.

To facilitate the water-cooling of the import electrode 31, in this embodiment, the import electrode 31 is a hollow structure. The water-cooling assembly may include a water-cooling seat 39, a water-cooling pipe 36, a water inlet connecting joint 38, and a water outlet connecting joint 37. The water-cooling seat 39 is sealingly docked to the second end of the import electrode 31. The water-cooling seat 39 has a flow passage 40 communicated with the inter part of the import electrode 31.

The first end of the water-cooling pipe 36 is fixedly provided in the flow passage 40 and connected to the water inlet connecting joint 38, and the second end thereof extends out of the water-cooling seat 39 and is inserted into the inter part of the import electrode 31. The water outlet connecting joint 37 is communicated with the flow passage 40.

Specifically, it is to be noted that cooling water enters the water-cooling pipe 36 from the water inlet connecting joint 38, flows out of the hollow part of the import electrode 31, then flows into the flow passage 40 made of water cooling, and ultimately flows out of the water outlet connecting joint 37. When heated, the electrode part heats up, and a temperature rises. The cooling water takes away heat to reduce the temperature of this zone, thereby preventing a high temperature from affecting a sealing device.

Figure 5:
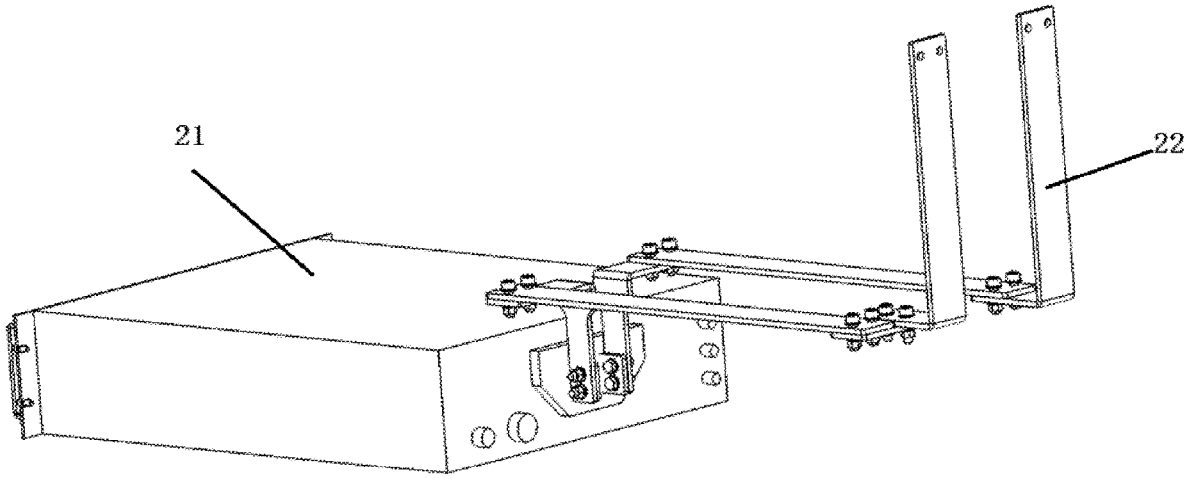
FIG. 5 shows a schematic structural diagram of a power supply assembly according to an embodiment of the disclosure.

As shown in FIG. 5, the power supply assembly 2 may include a DC power supply 21 and a connecting copper row 22. The two connecting copper rows 22 are provided. The first end of the connecting copper row 22 is connected to the DC power supply 21, and the second end thereof is connected to the importing electrode 31. The copper row may bear a large amount of current safely, and may be reasonably arranged to reduce an occupied space. The DC power supply 21 is configured to output a small voltage and a large current. Compared with a traditional voltage heating way with 220 V or 380 V, a heating way with the small voltage and the large current may meet a power required by the high temperature, while greatly simplifying the control way of the heating. A heating source is integrated into one DC power supply 21, thereby greatly reducing an occupied volume. The small voltage is less than 36 V, which is a safe voltage and may effectively prevent an electric shock accident, thereby further improving safety.

Further, the vacuum chamber may include an inner layer and an outer layer. A water-cooling sandwich layer is provided between the inner layer and the outer layer.

To facilitate temperature control, as shown in FIG. 1, in this embodiment, the vacuum sintering apparatus also may include at least two temperature-measuring thermocouples 5. The temperature-measuring thermocouple 5 is located on the outer layer of the vacuum chamber. The detection end of the temperature-measuring thermocouple 5 passes through the inner layer and the carbon felt heat-preservation layer 61. The temperature-measuring thermocouple 5 is configured to acquire the inner-side temperature of the heating body assembly 4 in real time. One temperature-measuring thermocouple 5 is configured to feed back the inner-side temperature to a control module. The control module controls the output of the power supply assembly 2 to control the heating power of the heating strip 42. The other temperature-measuring thermocouple is configured to feed back the inner-side temperature to the control module. The control module controls the power cut-off of the power supply assembly 2 when the inner-side temperature is higher than a set value. The control module may determine whether the temperature-measuring thermocouple 5 is normal based on the inner-side temperature obtained by the two temperature-measuring thermocouples 5.

The temperature-measuring thermocouple 5 adopts a high-temperature-type tungsten rhenium thermocouple, which may measure up to 2000° C. high temperature. The form of dual thermocouples is designed. One thermocouple is taken as a temperature control, collects and feeds back an actual temperature to the control module, and controls the output of the DC power supply 21 to control the heating power via a program, so as to achieve the control of a set temperature, and the other thermocouple is taken as a temperature limitation, and limits the maximum temperature of 1500° C., to achieve the over-temperature protection function of the system. The two thermocouples are calibrated against each other to check whether the thermocouple works properly and measures accurately.

In the disclosure, the defects and shortcomings in the prior art are solved. The heating body structure and the heating system are designed, integrating the vacuum and the heating system within a relatively small space. The entire system has a high space utilization rate and occupies a small zone. The compact and efficient heat-preservation structure is designed. An excellent heat-preservation effect reduces the heat loss, so that the energy consumption of the system is greatly reduced, thereby shrinking production costs.

The foregoing is merely optional embodiments of the disclosure and is not intended to limit the disclosure. The disclosure may have various changes and variations for a person skilled in the art. Any modifications, equivalent substitutions, improvements, etc. made within the spirit and principles of the disclosure shall be included in the scope of protection of the disclosure.

Various embodiments of the disclosure may have one or more of the following effects. In some embodiments, the disclosure may provide a vacuum sintering apparatus which may help to solve the problems that for a vacuum sintering furnace in the prior art, to implement a sintering environment with a high temperature and high vacuum, a corresponding vacuum system and a heating system are complex and occupy a large space so that a vacuum sintering apparatus in the industry at present has a large volume, occupies a large space, and has high energy consumption. In other embodiments, the disclosure may provide a vacuum sintering apparatus, which may include a vacuum cavity body, a power supply assembly, an electrode assembly, a heating body assembly, and a heat-preservation assembly. In further embodiments, the disclosure may show one or more of the following effects: vacuum and the heating system may be integrated within a small space, the whole system may have high space utilization and occupy a small zone, and the embodiment may have the design of a compact and efficient heat-preservation structure and excellent heat-preservation effect which reduces heat loss, so that the energy consumption of the system may be greatly reduced, thereby reducing production costs. Such embodiment may further help to solve the problems that for the vacuum sintering furnace in the prior art to implement the sintering environment with the high temperature and the high vacuum when the corresponding vacuum system and the heating system are complex and occupy a large space so that the vacuum sintering apparatus in the industry at present has the large volume, occupying a large space and having a high energy consumption.

Many different arrangements of the various components depicted, as well as components not shown, are possible without departing from the spirit and scope of the present disclosure. Embodiments of the present disclosure have been described with the intent to be illustrative rather than restrictive. Alternative embodiments will become apparent to those skilled in the art that do not depart from its scope. A skilled artisan may develop alternative means of implementing the aforementioned improvements without departing from the scope of the present disclosure.

It will be understood that certain features and subcombinations are of utility and may be employed without reference to other features and subcombinations and are contemplated within the scope of the claims. Unless indicated otherwise, not all steps listed in the various figures need be carried out in the specific order described.

The disclosure claimed is:

1. A vacuum sintering apparatus, comprising a vacuum cavity body, a power supply assembly, an electrode assembly, a heating body assembly, and a heat-preservation assembly, wherein:

the vacuum cavity body comprises a vacuum chamber, the vacuum chamber being configured to be connected to a vacuum pump;

the heat-preservation assembly is provided within the vacuum chamber, the heat-preservation assembly comprises a fixing bracket and a carbon felt layer, the fixing bracket is provided in a square shape or an annular shape, and the carbon felt layer is laid around the fixing bracket;

the heating body assembly is provided in a zone surrounded by the carbon felt layer, the heating body assembly comprises two groups of unidirectional heating channels, the unidirectional heating channels are in an unenclosed square shape or an unenclosed annular shape, the two groups of unidirectional heating channels are connected in series by a connecting member, and the connecting member is made of a conductive material; and the electrode assembly is provided at an outer side of the vacuum cavity body and comprises two groups of electrode assembly parts, the two groups of electrode assembly parts extend into the vacuum chamber and are connected to the two groups of unidirectional heating channels; and the electrode assembly is electrically connected to the power supply assembly.

2. The vacuum sintering apparatus according to claim 1, wherein:

one group of unidirectional heating channel is in the unenclosed square shape, and the one group of unidirectional heating channel comprises three first heating blocks, a second heating block, and heating strips, the three first heating blocks and the second heating block being distributed at four corners and the heating strips being distributed on four sides;

heating strips located on three of the four sides are connected in series via the three first heating blocks and the second heating block, one end of heating strip located on fourth side of the four sides is connected to a neighboring first heating block, another end of heating strip located on fourth side of the four sides is not in contact with the second heating block an is connect to the connecting member;

the heating strips distributed on the four sides are uniformly distributed along an axial direction of the vacuum chamber; and the second heating block is connected to the electrode assembly.

3. The vacuum sintering apparatus according to claim 2, wherein:

the two groups of unidirectional heating channels are distributed along the axial direction of the vacuum chamber;

the two first heating blocks along the axial direction of the vacuum chamber are connected to each other via a connecting strip; and the connecting strip is made of an insulating material.

4. The vacuum sintering apparatus according to claim 3, wherein:

the first heating blocks and the second heating block are provided with spacer blocks on outer sides;

the spacer blocks are made of the insulating material; and the spacer blocks are in contact with the carbon felt layer so that a heat-preservation spacing for forming a thermal field is provided among the first heating blocks, the second heating block, and the heating strips.

5. The vacuum sintering apparatus according to claim 4, wherein:

the first heating blocks and the second heating block are both provided in an L-shape, the first heating blocks and the second heating block are both provided with step-like lapping parts on inner sides, and an end of the heating strips is lapped to a corresponding lapping part and fixed by a fastening screw; and the second heating block is provided with a connecting part on an outer side, the connecting part passes through the heat-preservation assembly and is connected to the electrode assembly, the connecting part is sleeved with a spacer ring, the spacer ring is made of the insulating material, and the spacer ring separates the heat-preservation assembly from the connecting part.

6. The vacuum sintering apparatus according to claim 5, wherein:

the electrode assembly comprises an import electrode, a fixing board, a sealing board, a sealing ring, an export electrode, and a water-cooling assembly;

the fixing board is fixed to an outer side of the vacuum cavity body, the sealing board is fixed to the fixing board, the import electrode passes through and is provided in the sealing board and the fixing board, and the sealing ring is provided on the sealing board and sleeved on the import electrode;

a first end of the import electrode penetrates into an inter part of the vacuum cavity body and is connected to the connecting part, and a second end of the import electrode is connected to the water-cooling assembly; and the export electrode is connected to the import electrode.

7. The vacuum sintering apparatus according to claim 6, wherein:

the import electrode is threadedly connected to the connecting part;

the import electrode is a hollow structure, the water-cooling assembly comprises a water-cooling seat, a water-cooling pipe, a water inlet connecting joint, and a water outlet connecting joint;

the water-cooling seat is butted against a second end of the import electrode, and the water-cooling seat comprises a flow passage that is internally communicated with the import electrode; and a first end of the water-cooling pipe is provided within the flow passage and connected to the water inlet connecting joint, and a second end of the water-cooling pipe extends out of the water-cooling seat and is inserted into an inter part of the import electrode, and the water outlet connecting joint is communicated with the flow passage.

8. The vacuum sintering apparatus according to claim 7, wherein:

the power supply assembly comprises a DC power supply and two connecting copper rows;

a first end of the connecting copper rows is connected to the DC power supply; and a second end of the connecting copper rows is connected to the import electrode.

9. The vacuum sintering apparatus according to claim 1, wherein:

the carbon felt layer comprises a plurality of carbon felt heat-preservation boards spliced together; and adjacent carbon felt heat-preservation boards overlaps each other.

10. The vacuum sintering apparatus according to claim 1, wherein:

the vacuum chamber comprises an inner layer and an outer layer;

a water-cooling sandwich layer is provided between the inner layer and the outer layer;

the vacuum sintering apparatus further comprises at least two temperature-measuring thermocouples, the temperature-measuring thermocouples being provided on the outer layer of the vacuum chamber and a detection end of the temperature-measuring thermocouples passing through the inner layer and the carbon felt layer;

the temperature-measuring thermocouples are configured to obtain an inner-side temperature of the heating body assembly in real time, one temperature-measuring thermocouple is configured to feed back the inner-side temperature to a control module, the control module controls an output of the power supply assembly to control a heating power of heating strips, and another temperature-measuring thermocouple is configured to feed back the inner-side temperature to the control module, and the control module controls power cut-off of the power supply assembly when the inner-side temperature is higher than a set value; and the control module is configured to determine whether the temperature-measuring thermocouples are normal based on the inner-side temperature obtained by the two temperature-measuring thermocouples.

* * * * *